US006921440B2

(12) United States Patent
Liesert et al.

(10) Patent No.: US 6,921,440 B2
(45) Date of Patent: Jul. 26, 2005

(54) NIOBIUM-STABILIZED 14% CHROMIUM FERRITIC STEEL, AND USE OF SAME IN THE AUTOMOBILE SECTOR

(75) Inventors: Silke Liesert, Pontcharra (FR); Laurent Antoni, Pontcharra (FR); Pierre Olivier Santacreu, Ugine (FR)

(73) Assignee: Ugine SA, Puteaux (FR)

( * ) Notice: Subject to any disclaimer, the term of this patent is extended or adjusted under 35 U.S.C. 154(b) by 10 days.

(21) Appl. No.: 10/097,008

(22) Filed: Mar. 14, 2002

(65) Prior Publication Data

US 2002/0129877 A1 Sep. 19, 2002

Related U.S. Application Data

(62) Division of application No. 09/658,110, filed on Sep. 8, 2000, now Pat. No. 6,423,159.

(30) Foreign Application Priority Data

Sep. 9, 1999 (FR) ..... 99 11257

(51) Int. Cl.[7] ..... C22C 38/22; C22C 38/26
(52) U.S. Cl. ..... 148/325; 420/68; 420/69
(58) Field of Search ..... 420/68, 69, 34, 420/70; 148/603, 609, 610, 325

(56) References Cited

U.S. PATENT DOCUMENTS 3,963,532 A * 6/1976 Demo, Jr. ..... 148/37
4,484,956 A 11/1984 Shida et al.
4,515,644 A * 5/1985 Sawatani et al. ..... 148/608
4,726,853 A * 2/1988 Gressin et al. ..... 148/610
5,019,332 A * 5/1991 Wegman et al. ..... 420/59
5,505,797 A * 4/1996 Yokota et al. ..... 148/610

FOREIGN PATENT DOCUMENTS

| | | | |
|---|---|---|---|
| EP | 0 225 263 | 6/1987 | |
| EP | 0 391 054 | 10/1990 | |
| EP | 0 678 587 | 10/1995 | |
| JP | 49-62314 A * | 6/1974 | ..... C22C/38/26 |
| JP | 05-293595 A * | 11/1993 | |
| JP | 05-331552 A * | 12/1993 | |
| JP | 11-092872 A * | 4/1999 | |

OTHER PUBLICATIONS

Machine translation of Abe et al (JP 11–092872 A).*
Chemical Abstracts, vol. 130, No. 20, May 17, 1999, Abe, Masayuki et al. "Ferritic Stainless Steels Having Excellent Surface Properties and their Preparation", XP 002139529.

* cited by examiner

*Primary Examiner*—Roy King
*Assistant Examiner*—Henry D. Wilkins, III
(74) *Attorney, Agent, or Firm*—Oblon, Spivak, McClelland, Maier & Neustadt, P.C.

(57) ABSTRACT

A process for production of sheet-metal strip of niobium-stabilized 14% chromium ferritic steel, characterized in that certain steel is subjected to:

cold rolling of the hot sheet metal with or without preliminary annealing, final annealing of the sheet-metal strip at a temperature of between 800° C. and 1100° C. for a duration of between 1 minute and 5 minutes and preferably at a temperature of about 1050° C. for a time of about 2 minutes. Steel and exhaust manifold.

3 Claims, 2 Drawing Sheets

NIOBIUM-STABILIZED 14% CHROMIUM FERRITIC STEEL, AND USE OF SAME IN THE AUTOMOBILE SECTOR

This application is a Divisional of U.S. application Ser. No. 09/658,110, filed on Sep. 8,2000, now U.S. Pat. No. 6,423,159.

FIELD OF THE INVENTION

The invention relates to a niobium-stabilized 14% chromium ferritic steel, and to use of same in the automobile sector.

DISCUSSION OF THE BACKGROUND

The steels used for parts situated upstream from an exhaust system of a motor vehicle, the hot part of the system, must have both good resistance to oxidation and good creep resistance. Good formability is also necessary for manufacture of the manifold. The steels used for these hot parts are often either austenitic steels, which are relatively expensive and have poor oxidation resistance, although their formability is good, or bistabilized ferritic steels. The bistabilized ferritic steels have good oxidation resistance but are relatively difficult to form.

OBJECT OF THE INVENTION

One goal of the invention is to provide an economical ferritic steel which exhibits very good resistance to both creep and oxidation at temperatures up to 1000° C. as well as improved hardness for forming purposes.

DETAILED DESCRIPTION OF THE INVENTION

The object of the invention is realized with a process for producing a sheet-metal strip of niobium-stabilized 14% chromium ferritic steel, wherein steel with the following composition by weight based on total weight:

carbon≦0.02%
0.002%≦nitrogen≦0.02%
0.05%≦silicon≦1%
0%<manganese≦1%
0.2%≦niobium≦0.6%
13.5%≦chromium≦16.5%
0.02%≦molybdenum≦1.5%
0%<copper≦1.5%
0%<nickel≦0.2%
0%<phosphorus≦0.020%
0%<sulfur≦0.003%
0.005%<tin≦0.04%
impurities inherent to smelting and iron wherein the content of niobium, carbon and nitrogen satisfy the relationship:

$$9.5 \leqq Nb/(C+N),$$

is subjected to:

reheating before hot rolling at a temperature of between 1150° C. and 1250° C. and preferably at about (±15° C.) 1175° C., coiling at a temperature of between 600° C. and 800° C. and preferably of about (±15° C.) 600° C., cold rolling of the coil with or without preliminary annealing, final annealing of the sheet-metal strip at a temperature of between 800° C. and 1100° C. for a duration of between 1 minute and 5 minutes and preferably at a temperature of about (±15° C.) 1050° C. for a time of about (±15 sec) 2 minutes.

The other optional characteristics of the invention are:

after final annealing or before use, the sheet metal is subjected to heat treatment at a temperature of between 800° C. and 1000° C. for a time of between 1 minute and 100 hours and preferably at a temperature of about (±15° C.) 850° C. for a time equal to or less than 30 minutes.

The invention also relates to a niobium-stabilized 14% chromium ferritic steel comprising, consisting of, and consisting essentially of, iron and the following by weight based on total weight:

carbon≦0.02%
0.002%≦nitrogen≦0.02%
0.05%≦silicon≦1%
0%<manganese≦1%
0.2%≦niobium≦0.6%
13.5%≦chromium≦16.5%
0.02%≦molybdenum≦1.5%
0%<copper≦1.5%
0%<nickel≦0.2%
0%<phosphorus≦0.020%
0%<sulfur≦0.003%
0.005%<tin≦0.04%
impurities inherent to smelting, wherein the content of niobium, carbon and nitrogen satisfy the relationship:

$$9.5 \leqq Nb/(C+N).$$

Other optional characteristics of the invention are:

the Nb content satisfies the relationship $0.1 \leqq \Delta Nb \leqq 0.5$, where $\Delta Nb = Nb - 7(C+N)$ and preferably $0.2 \leqq \Delta Nb \leqq 0.3$ the contents of niobium, silicon and molybdenum satisfy the relationship: $\Delta Nb/(Si+Mo) \leqq 0.9$ the contents by weight of niobium and tin satisfy the relationship:

$$\Delta Nb/Sn \leqq 50$$

the contents of manganese and silicon satisfy the relationship:

$$Si/Mn \leqq 1.$$

The contents of niobium, titanium, zirconium and aluminum satisfy the relationship:

$$Nb/(Ti+Zr+Al) \geqq 0.16$$

after heat treatment, the steel contains an intermetallic phase of Fe2Nb3 type with tetragonal structure at the grain boundaries.

The invention also relates to use of the ferritic steel sheet metal in the automobile sector, particularly for production of exhaust system manifolds.

BRIEF DESCRIPTION OF THE DRAWINGS

The invention will be well understood by referring to the description hereinafter and the attached figures.

Figure 1A:
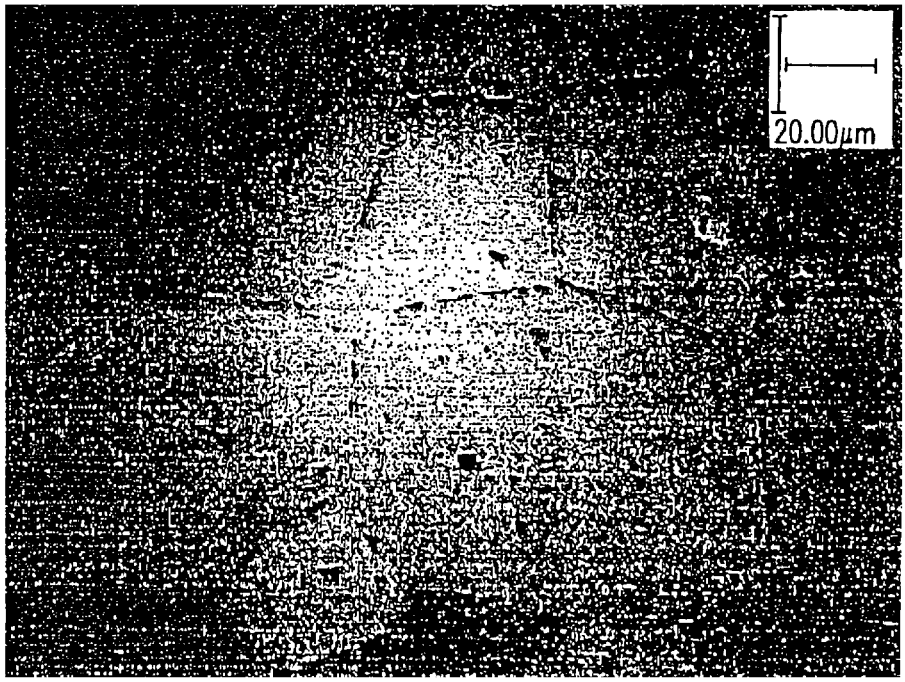
FIGS. 1A and 1B respectively exhibit the micrograph of a steel according to the invention (No. 1 in Tables I and II), and the micrograph of a comparison steel (No. 6 in Tables I and II) after heat treatment of each of the two steels, which have the same ΔNb of about 0.25%.
Figure 1B:
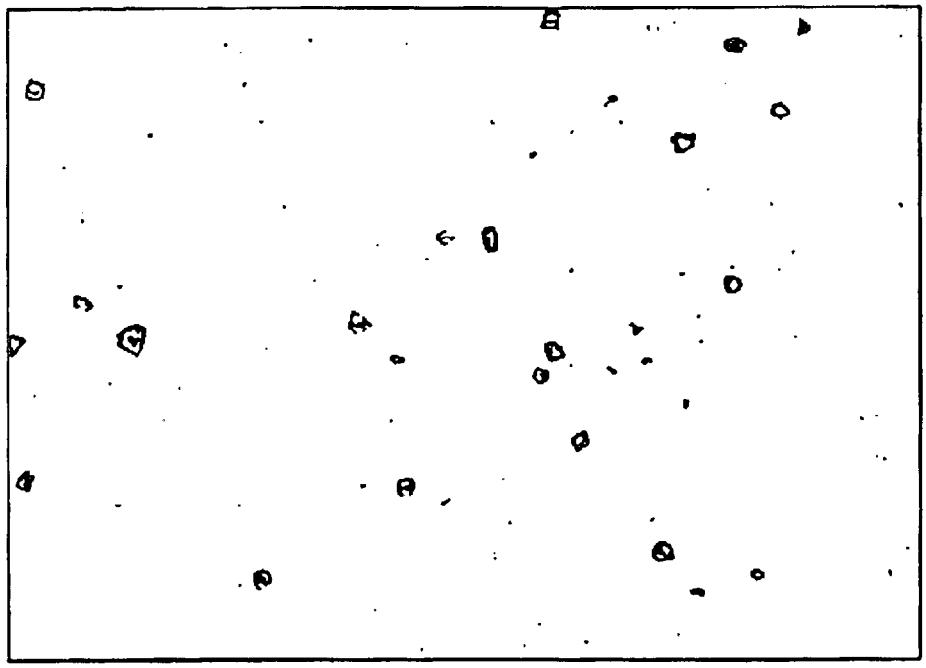
Figure 2:
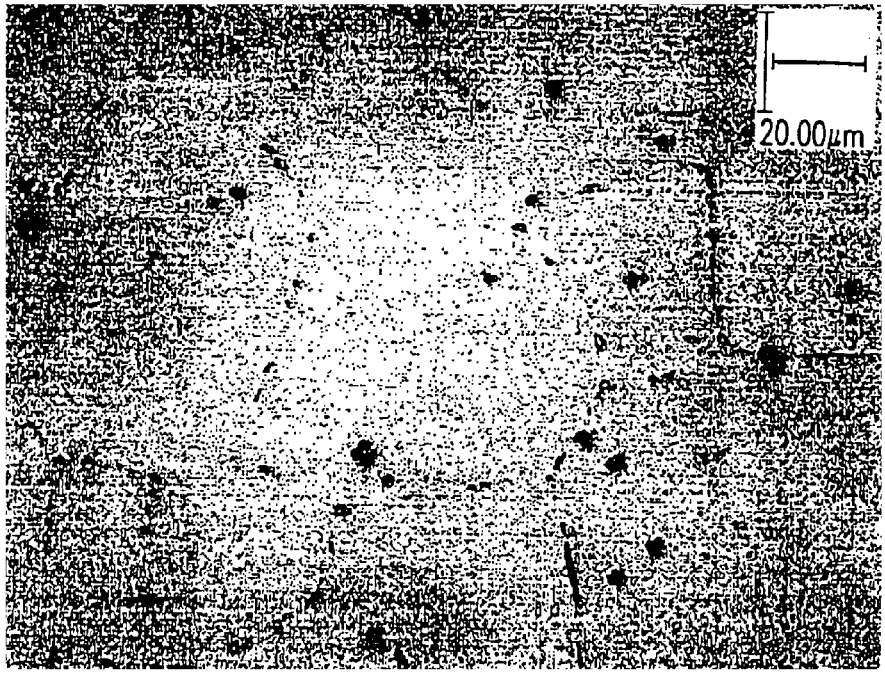
FIG. 2 exhibits the micrograph of a comparison steel (No. 9 in Tables I and II) with a relatively high ΔNb of about 0.43%, wherein intergranular precipitates of Fe2Nb type distributed in disordered manner are present after heat treatment.

The ferritic steels containing elements such as titanium, zirconium, aluminum and manganese as listed in the compositions of steels Nos. 5 to 9 in Tables I and II exhibit the Fe2Nb Laves phase as intermetallic phase at all temperatures. For a value of $\Delta Nb \leqq 0.3\%$, the Fe2Nb Laves phase is completely in solution at temperatures equal to or higher than 950° C., as shown in FIG. 1B. This explains the poor creep resistance behavior of these steels at or above 950° C.

Although the elements such as titanium, zirconium or aluminum are to be avoided in the composition of the steel according to the invention, they nevertheless can be present in the composition in contents such as:

titanium$\leqq$0.01%
zirconium$\leqq$0.01%
aluminum$\leqq$0.1% and preferably satisfy the relationship:

$$Nb/(Ti+Zr+Al) \leqq 0.16$$

In the steels according to the invention in which the elements are present in the following contents: molybdenum between 0.02% and 1%, silicon between 0.05% and 1%, and tin between 0.005% and 0.04%, and in which the relationships $\Delta Nb/(Si+Mo) \leqq 0.9$, $Si/Mn \geqq 1$, $\Delta Nb/Sn \leqq 50$ and $Nb/(Ti+Zr+Al) \geqq 0.16\%$ are satisfied, we find the Fe2Nb Laves phase only at low temperature, or in other words about 650° C. At higher temperatures, or in other words at or above 700° C., the type Fe2Nb3 quadratic phase is the only intermetallic phase observed. This phase has lower solubility than does the Fe2Nb Laves phase. For a low $\Delta Nb$ of 0.23%, a large proportion of Fe2Nb3 remains present even at 950° C., as can be seen on the micrograph of FIG. 1A. The presence of the Fe2Nb3 phase in substantial quantity at high temperature has the advantage of generating very good creep resistance and formability of the steels according to the invention.

The Fe2Nb Laves phase is an intermetallic compound which, when it is present in a steel, precipitates in disordered intragranular form at the grain boundaries and does not sufficiently prevent grain-boundary displacement, and so the material is subject to creep. A large quantity of this intermetallic precipitate is necessary to improve the creep resistance.

Figure 3:
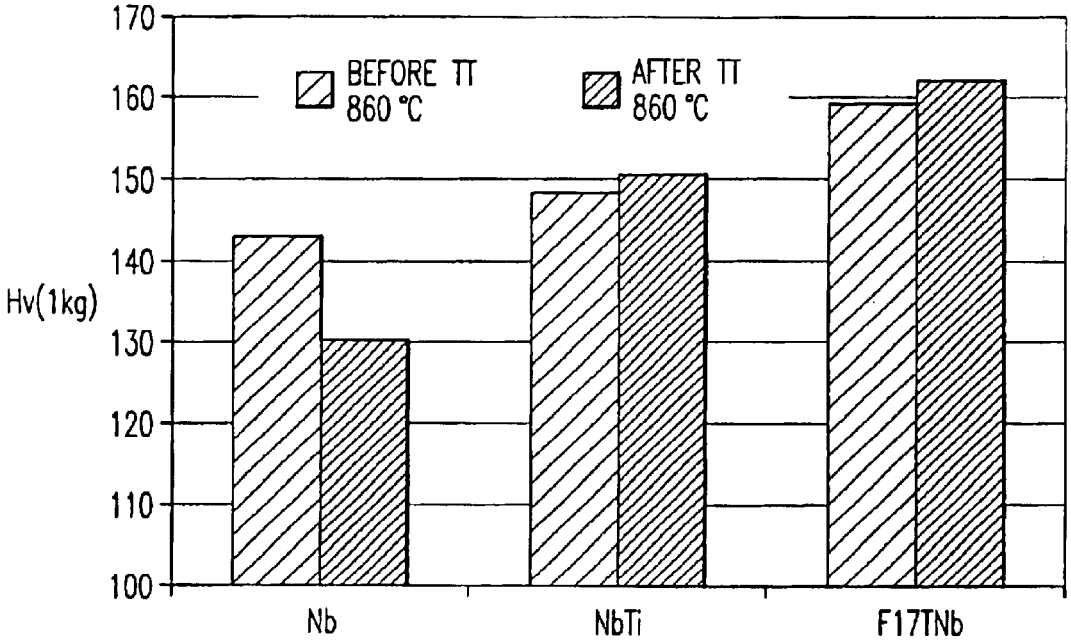
FIG. 3 presents the mechanical hardness characteristics for a steel according to the invention (No. 1 in Tables I and II) and two comparison steels (Nos. 6 and 9 in Tables I and II), before and after heat treatment to induce formation of type Fe2Nb3 or Fe2Nb precipitates respectively.

The precipitation of the Fe2Nb3 phase at the grain boundaries ensures reduction of the hardness of the steel compared with a steel in which all the intermetallic precipitates have passed into solution or have precipitated in intragranular form (FIG. 3).

If the Si/Mn ratio does not satisfy the criterion of being greater than 1, the Fe2Nb3 intermetallic phase is still formed. However, the manganese increases the solubility of the Fe2Nb3 intermetallic phase and the formation, at high temperature, of a phase Z of CrNbN type in the grains. Thus the Fe2Nb3 intermetallic phase dissolves at 950° C. The steel has poor creep and oxidation resistance. The silicon compensates for this effect.

To ensure good formability and good creep resistance, which is manifested by a substantial quantity of intermetallic precipitates at the grain boundaries, there was performed, after final annealing or before use, a heat treatment at a temperature on the order of 900° C., preferably on the order of 850° C., for a relatively short period, less than or equal to 30 minutes. The heat treatment permits a very fine homogeneous precipitation of the Fe2Nb3 phase at the grain boundaries. These precipitates act as nucleation centers. They permit very homogeneous precipitation of the Fe2Nb3 phase at the grain boundaries at all temperatures higher than or equal to 750° C., and this is favorable for good creep resistance.

To improve the corrosion resistance, copper can be added in a moderate concentration, lower than or equal to 1.5%.

Table I presents the chemical analyses of the studied alloys. Alloys 1 to 4 are alloys according to the invention. Alloys 5 to 9 are comparison examples.

Table II presents the results for creep at 950° C. after 100 hours, for cyclic oxidation at 950° C. and 1000° C. after 200 hours, for hardness after final annealing and after heat treatment at 850° C. according to the invention, and for $\Delta Nb$, for the intermetallic type present at T>700° C. and for the presence or absence of intermetallic phases at 950° C. This table also indicates whether or not the relationships are satisfied by the elements of the listed compositions.

The compositions which satisfy all the relationships and which therefore exhibit the best characteristics in terms of creep, oxidation and hardness before and after heat treatment, in combination with the lowest $\Delta Nb$, are alloys 1 to 4 according to the invention.

French patent application No. 99 11257 filed Sep. 9, 1999 is incorporated herein by reference.

TABLE I

| | Steel | No. | Cr | Mo | Si | Mn | Al | Ti | Nb | Zr | C | N | Sn | ΔNb |
|---|---|---|---|---|---|---|---|---|---|---|---|---|---|---|
| Claimed alloys | Nb | 1 | 14 | 0.02 | 0.5 | 0.2 | — | — | 0.4 | — | 0.012 | 0.015 | 0.01 | 0.23 |
| | NbMo | 2 | 14 | 1 | 0.5 | 0.2 | — | — | 0.4 | — | 0.012 | 0.015 | 0.01 | 0.23 |
| | NbSi | 3 | 14 | 0.02 | 1 | 0.2 | — | — | 0.4 | — | 0.012 | 0.015 | 0.01 | 0.23 |
| | NbSiMn | 4 | 14 | 0.02 | 1 | 1 | — | — | 0.4 | — | 0.012 | 0.015 | 0.01 | 0.23 |
| | NbMn | 5 | 14 | 0.02 | 0.05 | 1 | — | — | 0.4 | — | 0.012 | 0.015 | 0.001 | 0.23 |
| Comparison examples | NbTi | 6 | 14 | 0.02 | 0.05 | 0.2 | — | 0.1 | 0.4 | — | 0.012 | 0.015 | 0.003 | 0.26 |
| | NbAl | 7 | 14 | 0.02 | 0.05 | 0.2 | 1 | — | 0.4 | — | 0.012 | 0.015 | 0.004 | 0.31 |
| | NbZr | 8 | 17 | 0.02 | 0.06 | 0.5 | — | — | 0.4 | 0.45 | 0.016 | 0.016 | 0.002 | 0.39 |
| | NbTi | 9 | 17 | 0.02 | 0.06 | 0.5 | — | 0.14 | 0.5 | | 0.016 | 0.016 | 0.002 | 0.43 |

TABLE II

| Steel | No. | ΔNb % | Relationship 1: N/(Ti + Zr + Al) ≧ 0.16 | Relationship 2: Si/Mn ≧ 1 | Relationship 3: ΔNb/Sn ≦ 50 | Relationship 1 + 2 + 3 | Formed at T > 700° C. | Presence at 950° C. | Creep 950° C. | Oxidation at 950° C. | Oxidation at 1000° C. | Hardness (HV1) | Hardness (HV1) after heat treatment at 850° C. |
|---|---|---|---|---|---|---|---|---|---|---|---|---|---|
| Nb | 1 | 0 23 | • | • | • | • | Fe2Nb3 | ▲ | 5 | X | X | 143 | 130 |
| NbMo | 2 | 0.23 | • | • | • | • | Fe2Nb3 | ▲ | 2 | X | X | 147 | 141 |
| NbSi | 3 | 0.23 | • | • | • | • | Fe2Nb3 | ▲ | 2 | X | X | 158 | |
| NbSiMn | 4 | 0.23 | • | • | • | • | Fe2Nb3 | ▲ | 4 | X | X | 156 | |
| NbMn | 5 | 0.23 | • | ○ | • | ○ | Fe2Nb3 | □ | 20 | ○ | ○ | 152 | |
| NbTi | 6 | 0.26 | ○ | • | ○ | ○ | Fe2Nb | □ | 20 | ○ | ○ | 148 | 150 |
| NbAl | 7 | 0.31 | ○ | • | ○ | ○ | Fe2Nb | □ | 41 | X | X | 160 | |
| NbZr | 8 | 0.39 | ○ | • | ○ | ○ | Fe2Nb | ▲ | 11 | X | X | 161 | |
| NbTi | 9 | 0.43 | ○ | • | ○ | ○ | Fe2Nb | ▲ | 9 | X | X | 159 | 163 |

○ Not resistant to oxidation
X Resistant to oxidation
□ Absent
▲ Present
• Satisfies the relationship
o Does not satisfy the relationship

What is claimed is:

1. An exhaust system manifold comprising niobium-stabilized chromium ferritic steel comprising iron and the following by weight based on total weight:

carbon≦0.02%

0.002%≦nitrogen≦0.02%

0.05%≦silicon≦1%

0%<manganese≦1%

0.2%≦niobium≦0.6%

13.5%≦chromium≦16.5%

0.02%≦molybdenum≦1.5%

0%<copper≦1.5%

0%<nickel≦0.2%

0%<phosphorus≦0.020%

0%<sulfur≦0.003%

0.005%<tin≦0.04% zirconium≦0.01%, impurities inherent to smelting, wherein the content of niobium, carbon and nitrogen satisfy the relationship:

9.5≦ Nb/(C+N), and wherein the Nb content satisfies the relationship 0.1≦ΔNb≦0.5, where ΔNb=Nb−7 (C+N).

2. An exhaust system manifold comprising niobium-stabilized chromium ferritic steel comprising iron and the following by weight based on total weight:

carbon≦0.02%

0.002%≦nitrogen≦0.02%

0.05%≦silicon≦1%

0%<manganese≦1%

0.2%≦niobium≦0.6%

13.5%≦chromium≦16.5%

0.02%≦molybdenum≦1.5%

0%<copper≦1.5%

0%<nickel≦0.2%

0%<phosphorus≦0.020%

0%<sulfur≦0.003%

0.005%<tin≦0.04% zirconium≦0.0 1%, impurities inherent to smelting, wherein the content of niobium, carbon and nitrogen satisfy the relationship:

9.5≦Nb/(C+N), and wherein the contents of niobium, silicon and molybdenum satisfy the relationship: ΔNb/(Si+Mo)≦0.9, where ΔNb=Nb−7 (C+N).

3. An exhaust system manifold comprising niobium-stabilized chromium ferritic steel comprising iron and the following by weight based on total weight:

carbon≦0.02%

0.002%≦nitrogen≦0.02%

0.05%≦silicon≦1% 0%<manganese≦1%

0.2%≦niobium≦0.6%

13.5%≦chromium≦16.5%

0.02%≦molybdenum≦1.5%

0%<copper≦1.5%

0%<nickel≦0.2%

0%<phosphorus≦0.020%

0%<sulfur≦0.003%

0.005%<tin≦0.04% zirconium≦0.01%, impurities inherent to smelting, wherein the content of niobium, carbon and nitrogen satisfy the relationship:

9.5≦Nb/(C+N), and wherein the contents of niobium and tin satisfy the relationship: ΔNb/Sn≦50, where ΔNb=Nb−7 (C+N).

* * * * *